United States Patent [19]

Agrawal et al.

[11] Patent Number: 4,543,115

[45] Date of Patent: Sep. 24, 1985

[54] DUAL FEED AIR PRESSURE NITROGEN GENERATOR CYCLE

[75] Inventors: Rakesh Agrawal; Kenneth W. Kovak, both of Allentown, Pa.

[73] Assignee: Air Products and Chemicals, Inc., Allentown, Pa.

[21] Appl. No.: 582,117

[22] Filed: Feb. 21, 1984

[51] Int. Cl.[4] ..... F25J 3/04

[52] U.S. Cl. ..... 62/25; 62/28; 62/29; 62/31; 62/34; 62/38

[58] Field of Search ..... 62/23, 24, 27, 28, 29, 62/30, 31, 32, 33, 34, 36, 38, 39, 42, 25

[56] References Cited

U.S. PATENT DOCUMENTS 4,222,756 9/1980 Thorogood .

4,451,275 5/1984 Vines et al. ..... 62/39

FOREIGN PATENT DOCUMENTS 1215377 12/1970 United Kingdom .

*Primary Examiner*—Frank Sever

*Attorney, Agent, or Firm*—Geoffrey L. Chase; E. Eugene Innis; James C. Simmons

[57] ABSTRACT

A nitrogen generating air separation system is disclosed having dual air feeds to dual, low and high pressure, distillation columns wherein a reboiler-condenser is mounted overhead of the high pressure column and a vaporizer-condenser is mounted overhead of the low pressure column and preferably a portion of the high pressure air feed is expanded and desuperheated before being introduced into the low pressure column.

19 Claims, 5 Drawing Figures

DUAL FEED AIR PRESSURE NITROGEN GENERATOR CYCLE

TECHNICAL FIELD

The present invention is directed to low temperature distillation, air separation systems for the production of nitrogen product. More specifically, the invention is directed to an energy efficient process and apparatus for the isolation of nitrogen from air in a dual feed, dual pressure column separation system.

BACKGROUND OF THE PRIOR ART

The production and availability of nitrogen as a product has been a desired goal which has been achieved with varying degrees of success in the past. The use of such nitrogen product has generally been on a small scale on a volumetric basis.

Recently, the use of nitrogen in large quantities has found utility in the maintenance and enhancement of petroleum recovery operations. Previously, such petroleum reserves, after depletion of natural pressure, were either terminated or natural gas co-recovered with the petroleum was reintroduced as a pressurizing medium for the petroleum. As the cost of both petroleum and natural gas have risen, it has become desirable to recover petroleum in low pressure or non-naturally producing reservoirs, and it has also become desirable to use pressure maintaining or pressure enhancing mediums other than natural gas.

In order to make such alternate pressurizing media cost effective, large quantities of the medium must be available at very low cost. Industries have turned to nitrogen as a readily available source of an inert pressurizing medium which is available in large quantities throughout the world. Large air separation plants have been constructed to provide the necessary quantities of nitrogen for pressure maintenance or enhanced petroleum recovery. In order to maintain nitrogen as an attractive medium for petroleum recovery operations, the cost must be maintained as low as possible. Various attempts to produce large quantities of nitrogen under efficient circumstances so as to have a cost effective quantity of nitrogen have been attempted by those skilled in the art.

In British Pat. No. 1,215,377 an air separation apparatus is set forth wherein nitrogen is produced as product of the air separation. Air is initially compressed and cooled before being cleansed of water and carbon dioxide in switching adsorbent beds. A portion of the cleaned air is then expanded through a work producing expansion means before the entire air stream is introduced into the high pressure stage of a two stage, low and high pressure distillation column. The overhead and the bottom stream from the high pressure column are introduced into the low pressure column as reflux to the low pressure column, respectively. A reboiler-condenser connects the low pressure column and the high pressure column thermodynamically. A portion of the nitrogen recovered in the condenser of the high pressure column is removed as product and rewarmed. A portion of the oxygen enriched waste from the bottom of the low pressure column is removed and expanded in order to condense nitrogen in the overhead of the low pressure column, while the enriched oxygen waste is reboiled and removed as a waste stream. A second nitrogen product at low pressure is removed from the upper region of the low pressure column as a product and is rewarmed, along with the other process streams from the column. However, this patented cycle delivers all of its feed air to the high pressure column and does not deliver any feed air directly to the low pressure column. This reduces the potential efficiency of the separation system. This system must also compress the feed air to a relatively high pressure, because the entire feed air stream is expanded to a reduced pressure, which is still equal to the pressure of the high pressure stage of the distillation column. This also would result in decreased efficiency.

Another two stage distillation column system for the generation of nitrogen product is set forth in U.S. Pat. No. 4,222,756 wherein the feed air is delivered entirely to a high pressure stage of the distillation column and refrigeration is supplied in large part by expansion of the entire nitrogen overhead from the high pressure stage through a turbine with delivery of the expanded nitrogen to the mid-section of the low pressure stage of the distillation column. A portion of the nitrogen is removed as product from the top of the low pressure stage of the distillation column while the remainder condenses in a vaporizer-condenser driven by oxygen enriched waste from the base of the low pressure stage in the distillation column. Various alternate nitrogen producing air separation plants are set forth in this patent in FIG. 1, FIG. 2 and FIG. 3. None of these cycles provide large quantities of nitrogen at the efficiency of operation of the present invention.

The present invention overcomes the drawbacks in efficiency of the prior art for the production of large volumes of nitrogen by providing a system which provides only the required high pressure column feed to generate the optimum low pressure column boilup vapor from the reboiler-condenser. The remaining portion of the total air feed is fed directly to the low pressure column. By minimizing the portion of the total feed air compressed to feed the high pressure column, the total energy input is minimized.

In addition, by uncoupling the expander flow from mass balance considerations, only the required air flow is taken to the expander. This reduces inefficiency in the heat exchanger-expander system by reducing requirements for bypasses around the expansion system.

BRIEF SUMMARY OF THE INVENTION

The present invention is directed to a process for the production of gaseous nitrogen by the low temperature distillation of air in two distillation columns comprising the steps of: producing two different pressure feed air streams by compression in order to have a low pressure feed air stream and a high pressure feed air stream; expanding a process stream through a turbine to reduce its pressure and temperature so as to provide refrigeration for the distillation process; introducing at least a portion of the high pressure feed air stream into a first high pressure distillation column; introducing the low pressure feed air stream into a second, low pressure, distillation column; condensing a nitrogen reflux stream in the high pressure column by heat exchange of the nitrogen of the high pressure column against the bottom liquid of the low pressure column in a reboiler-condenser, a portion of which reflux stream is expanded and introduced into the low pressure column as reflux; removing a bottom stream from the high pressure column, expanding it and introducing it into the low pressure column; condensing a nitrogen reflux stream in the low pressure column in a vaporizer-condenser against bottom liquid from said column which is expanded to a lower pressure and temperature and introduced into the vaporizer-condenser, and removing a portion of the overhead nitrogen vapor from the low pressure column as a product.

Preferably, the expanded process stream is a portion of the high pressure feed air stream which is subsequently desuperheated against another process stream and is then combined with the low pressure feed air stream and the combined stream is introduced into the low pressure column.

Alternately, the expanded feed air stream is directed through a reboiler in the low pressure distillation column where it reboils the column while it condenses, and this condensed stream is then introduced into the column as reflux.

Additionally, the present invention contemplates that refrigeration for the distillation process can be derived by expanding the high pressure feed air stream partially through a turbine and partially through a Joule Thomson valve to an intermediate pressure, which expansions still allow the expanded stream to be fed to the high pressure column.

The refrigeration for the distillation can alternately be derived from a product stream of nitrogen from the overhead of the high pressure column which is expanded through a turbine and heat exchanged against process streams. Optionally, a product stream of nitrogen from the low pressure column can be expanded through a turbine to provide refrigeration.

Finally, the waste, oxygen-enriched stream from the vaporizer-condenser at the top of the low pressure column can be expanded through a turbine to provide refrigeration.

The present invention is also directed to apparatus for the production of gaseous nitrogen by the low temperature distillation of air comprising: two distillation columns consisting of a high pressure column and a low pressure column connected by a reboiler-condenser; means for conducting a low pressure feed air stream to said low pressure column; means for conducting at least a portion of a high pressure feed air stream to said high pressure column; a turbine for expanding a high pressure process stream to a lower pressure and temperature; means for conducting a nitrogen stream from the reboiler-condenser between the two distillation columns to the low pressure column; means for conducting a bottom stream from the base of the high pressure column to the low pressure column; a vaporizer-condenser at the top of the low pressure column which is operated with a bottom stream from the base of the low pressure column; means for recovering a nitrogen product from the overhead of the low pressure column.

DETAILED DESCRIPTION OF THE INVENTION

The present invention provides a system for the production of relatively large quantities of nitrogen from air by low temperature or cryogenic distillation of air. Generally, the system enjoys enhanced efficiency over prior art nitrogen generator systems. Although plants of this size have particular applicability to the production of large volumes of nitrogen for petroleum recovery, it is apparent that such an efficient system would be applicable for other nitrogen end uses.

Figure 1:
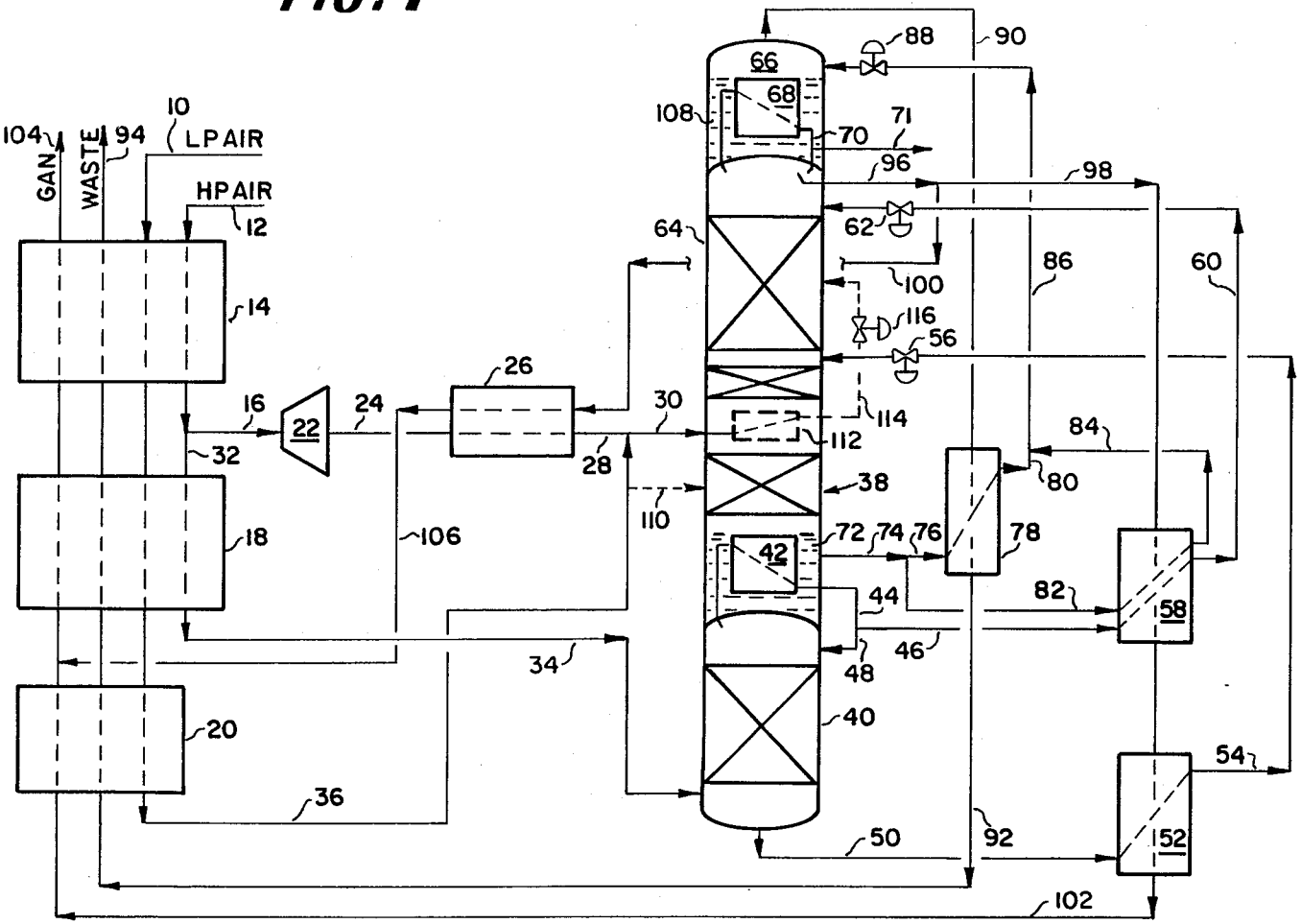
FIG. 1 represents a schematic flowscheme of the process and apparatus of the present invention with refrigeration derived by expansion of a part of the high pressure air feed, which is subsequently fed to the low pressure column.

The invention will presently be described in its preferred embodiment in greater detail with reference to FIG. 1. As shown in the schematic drawing of the distillation scheme, two separate feed air streams at different pressures are provided to the system from compression equipment which is not shown and which is deemed to be typical in the art. It is understood that the feed air has been purified of water and carbon dioxide by passage through a clean-up system, such as; molecular sieve beds of the switching arrangement wherein one bed is on-line, while an adjacent bed is being regenerated, preferably with waste, oxygen-enriched gas. Other clean-up systems can be used, as are presently well known in the art. The two feed air streams comprise a low pressure feed air stream in line 10 and a high pressure feed air stream in line 12. The low pressure feed air stream in line 10 is cooled against process streams, including product gaseous nitrogen in line 104 and waste, oxygen-enriched gas in line 94 by heat exchange in the main heat exchanger comprised of stage exchangers 14, 18 and 20. The cooled low pressure feed air stream in line 36 is then introduced into the low pressure distillation column 64 of a two column distillation apparatus 38.

The high pressure feed air stream in line 12 is initially cooled in exchanger 14 against the process streams in line 104 and 94 and then is split into an expander feed air stream in line 16 and a remaining high pressure feed stream in line 32. The remaining feed air stream is further cooled in exchanger 18 against process streams and is then introduced as feed in line 34 into the high pressure distillation column 40 of the two column distillation apparatus 38.

The expander feed air stream in line 16 is expanded through an expansion turbine or other work producing expansion engine 22 in order to reduce its pressure and temperature and to provide refrigeration for the distillation process. The thus expanded feed air stream, which is exhausted from the expansion turbine 22 in line 24, is then desuperheated in desuperheating heat exchanger 26 against a portion of the nitrogen product of the process. The desuperheating function reduces the temperature of the expanded gas in line 24 to a temperature at approximately the saturation point of the vapor making up the gas stream in line 24. This desuperheated stream, now in line 28, is combined with the low pressure feed air in line 36 and the combined stream in line 30 is introduced as feed to the low pressure column 64 of the distillation apparatus 38. Alternate methods for deriving refrigeration for distillation are shown in FIGS. 2–5.

Alternately, the feed to the low pressure column 64 may be accomplished by directing the low pressure feed air stream in line 36 directly into the low pressure distillation column 64 through alternate line 110. The desuperheated and expanded feed air stream in line 28 may be individually passed through an optional reboiler 112 in the low pressure distillation column in order to condense the desuperheated stream while reboiling a portion of the low pressure column 64. The condensed stream, now in line 114, is expanded through a valve 116 to lower temperature and pressure and is introduced as reflux at a point above the reboiler 112 in the low pressure distillation column 64.

Alternately, the feed to the low pressure column 64 may be accomplished by directing a desired portion of the low pressure feed air stream in line 36 through alternate line 110 with the remainder combining with stream 30. This proportional split is chosen such as to optimize the distillation in the columns.

The high pressure distillation column 40 and the low pressure distillation column 64 are connected thermodynamically by a reboiler-condenser 42 located at the overhead of the high pressure column 40 and in the base of the low pressure column 64. Oxygen enriched bottom liquid which collects in the base of the low pressure column 64 condenses nitrogen in the high pressure column which passes through the reboiler-condenser 42, while the bottom liquid 72 is reboiled and vaporized in the low pressure column. The condensed high pressure nitrogen now in line 44 is returned in part in line 48 as reflux for the high pressure column 40. A portion of the nitrogen reflux in line 44 is removed in line 46 and subcooled against product nitrogen in subcooling heat exchanger 58. The subcooled high pressure nitrogen now in line 60 is expanded to a lower temperature and pressure in valve 62 and introduced as reflux into the low pressure column 64 in the upper region thereof. Optionally, reboiler 112 can be located below reboiler-condenser 42 and several trays may separate the two units.

An oxygen enriched bottom liquid from the high pressure column 40 is removed as a bottom stream in line 50 and is also subcooled against product nitrogen in subcooling heat exchanger 52. The oxygen enriched bottom stream in line 54 is expanded to a lower temperature and pressure through valve 56 and is introduced as feed into the mid-section of the low pressure distillation column 64.

As previously stated, the low pressure column 64 is thermodynamically connected to the high pressure column through the reboiler-condenser 42. The oxygen enriched bottom liquid 72 which collects in the base of the low pressure column 64 is reboiled by the condensing nitrogen in reboiler-condenser 42 from the high pressure column 40. A portion of the bottom liquid which is not reboiled is removed in line 74 for condensing duty in the low pressure column 64. The bottom liquid in line 74 is split into a side stream in line 82 which is subcooled against product nitrogen in subcooling heat exchanger 58. The remaining bottom liquid stream in line 76 is also subcooled in subcooling heat exchanger 78 against waste, oxygen-enriched gas in line 90. The two subcooled streams in line 84 and 80, respectively, are combined in line 86 and reduced in temperature and pressure through valve 88 before being introduced for condensing duty as a liquid 108 which condenses nitrogen from the low pressure column 64 in a vaporizer-condenser 68. As the waste, oxygen-enriched liquid 108 condenses nitrogen, it is in turn vaporized in the overhead 66 of the distillation apparatus 38. This vaporized, waste, oxygen-enriched stream is removed in line 90 and rewarmed against process streams in subcooling heat exchanger 78 and exchangers 20, 18 and 14, before being removed in line 94 as a waste stream which can be utilized in low oxygen enrichment applications and/or for purging and regeneration of the molecular sieve beds in the clean-up system of the air separation system, not shown.

Nitrogen which has been stripped of oxygen contamination by the reflux streams in the low pressure distillation column collects as an overhead vapor phase in the top of that column. A portion of this overhead vapor is removed as product in line 96. The remaining nitrogen is then condensed as a liquid phase in the vaporizer-condenser 68 and returned as reflux in line 70 and potentially liquid product in line 71. The vapor product in line 96 is split into a sidestream 100 and a remaining nitrogen product stream in line 98. The nitrogen in line 98 is rewarmed against process streams in subcooling heat exchangers 58 and 52 before being further rewarmed in line 102 through main heat exchanger stages 20, 18 and 14. The nitrogen product sidestream in line 100 is rewarmed by passage through the desuperheating heat exchanger 26 which desuperheats and cools the expanded high pressure feed stream to its point of vapor saturation. The nitrogen product sidestream, now in line 106, is combined with the remaining nitrogen product stream between the stages 20 and 18 of the main heat exchanger, and the combined nitrogen product streams are rewarmed through stages 18 and 14 of the main heat exchanger, wherein the rewarmed nitrogen product is removed in line 104 as a gaseous nitrogen product preferably having an oxygen content of 5 ppm or less.

Alternate schemes for providing refrigeration for the process, set forth above and illustrated in a preferred embodiment in FIG. 1, are illustrated in FIGS. 2–5. Essentially the only alteration is the process stream from which the refrigeration for the process is derived. In the figures, like components correspond to the components comprehensively described for FIG. 1. Only the alterations from FIG. 1 as set forth in the discussion below and the respective figures are described in detail and are illustrated with heavy lining in the respective figures.

Figure 2:
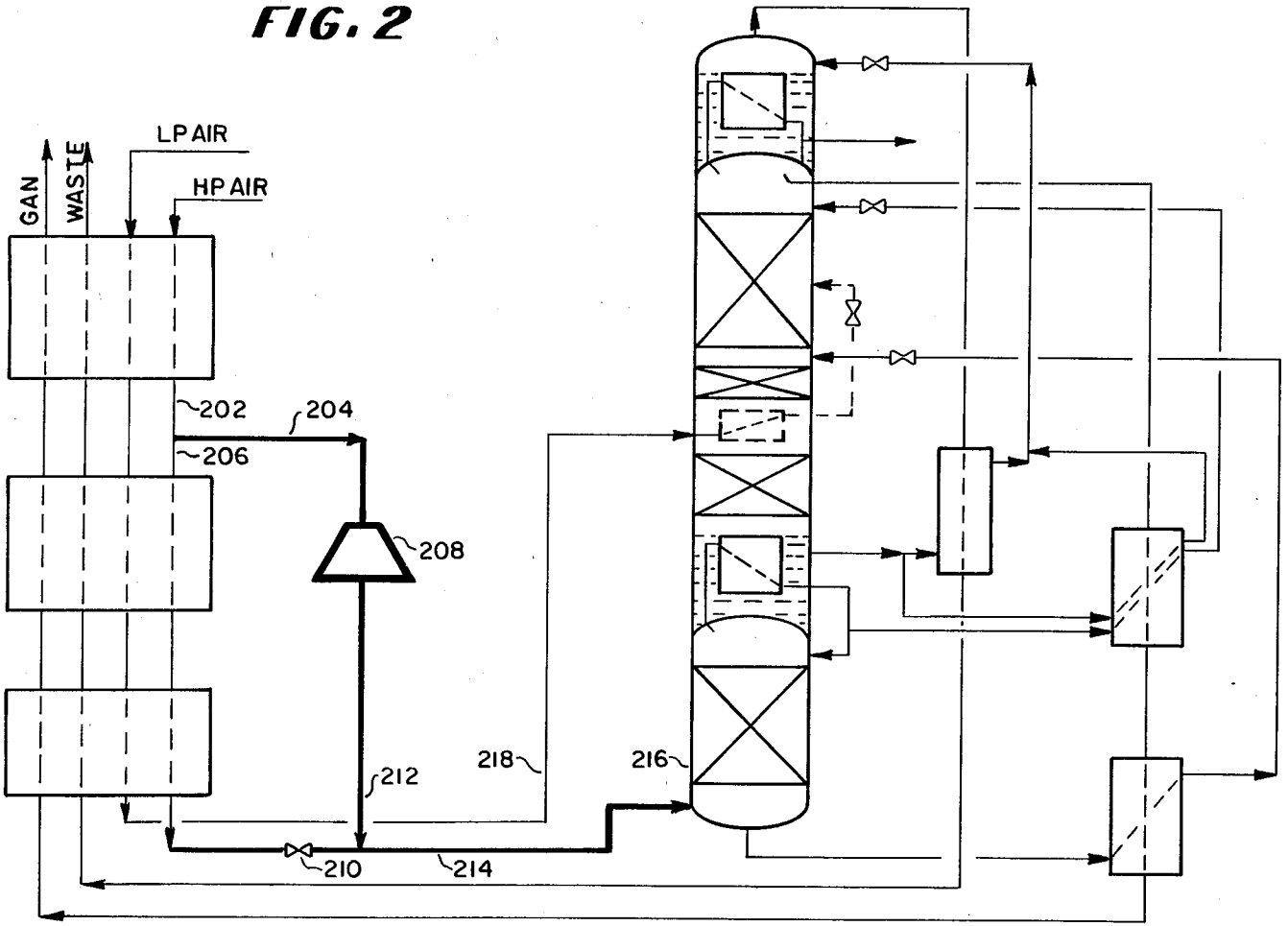
FIG. 2 represents an alternate scheme from FIG. 1 wherein refrigeration is derived by expansion of a part of the high pressure feed air which is subsequently fed to the high pressure column.

In FIG. 2, refrigeration is derived by splitting the high pressure feed air stream 202 into an expander feed stream 204 and a remaining stream 206. Stream 204 is expanded to an intermediate lower pressure and temperature in turbine 208 before the turbine exhaust stream 212 is combined with the remaining stream 206 which has been reduced in pressure through a Joule Thomson valve 210. The combined stream 214 is then introduced into the high pressure column 216. This is distinguished from the FIG. 1 scheme, where the turbine exhaust goes to the low pressure column. Because the high pressure feed after expansion goes entirely to the high pressure column, the low pressure air feed stream in line 218 is directed individually to the low pressure column.

Figure 3:
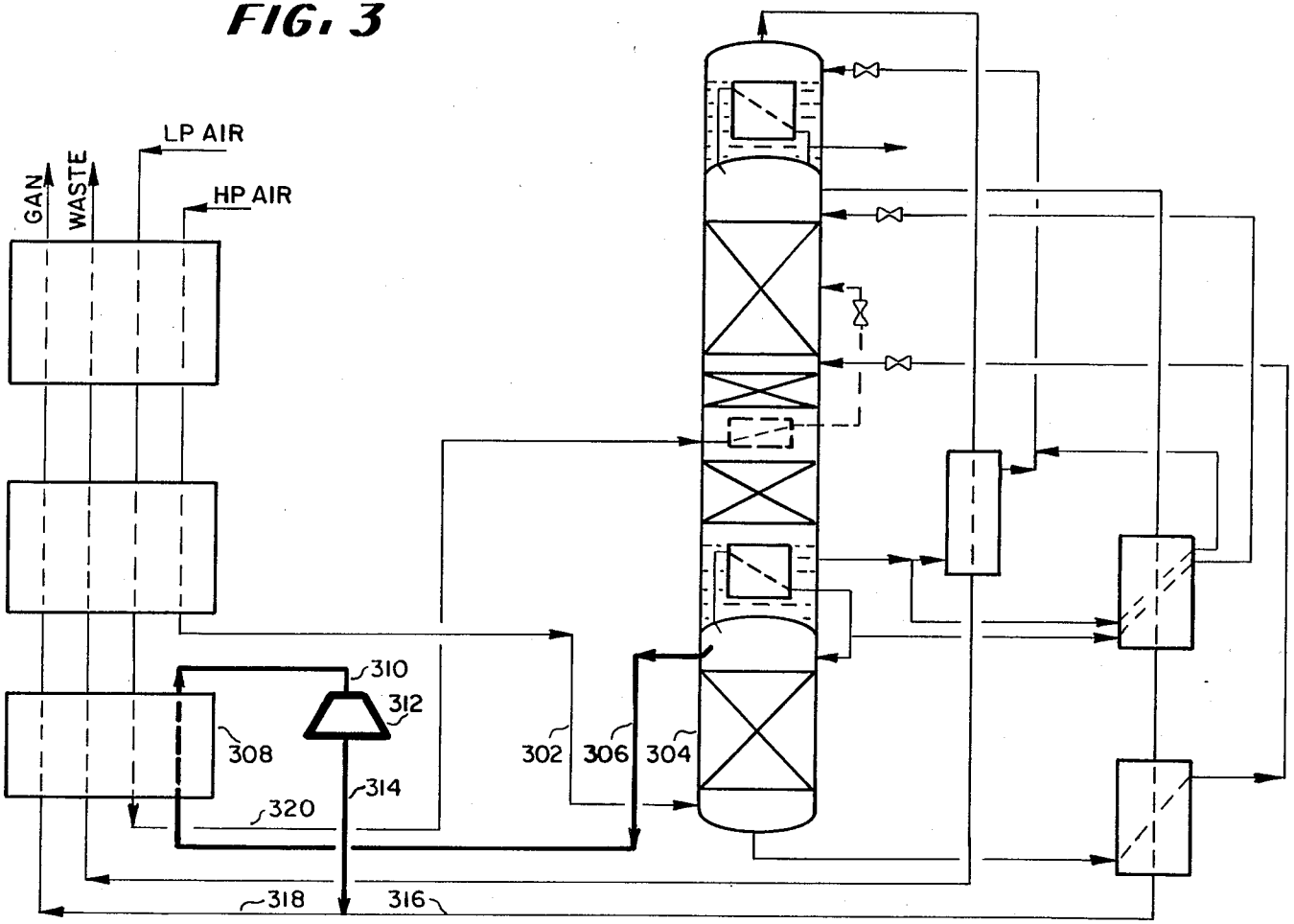
FIG. 3 represents an alternate scheme from FIG. 1 in which high pressure nitrogen is expanded to provide refrigeration.

In FIG. 3, refrigeration is derived by removing a high pressure nitrogen product from the high pressure column 304 in line 306. The stream is rewarmed in heat exchanger 308. The rewarmed stream 310 is expanded to lower pressure and temperature in turbine 312. The turbine exhaust 314 is combined with the low pressure nitrogen product 316 from the low pressure column and the combined stream 318 provides heat exchange against process streams in the main heat exchanger. The high pressure feed air stream 302 goes directly to the high pressure column 304 and the low pressure feed air stream 320 goes directly to the low pressure column.

Figure 4:
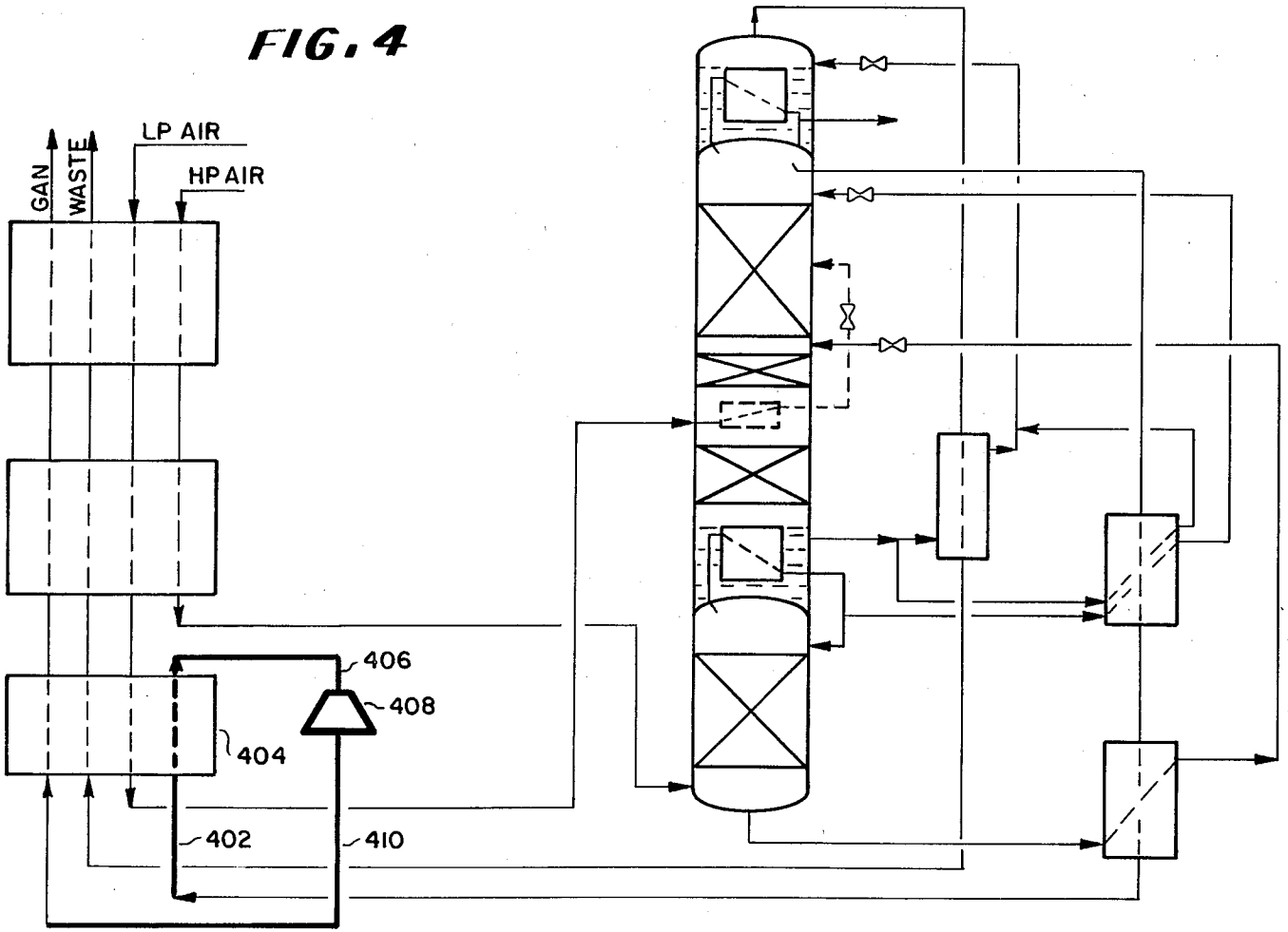
FIG. 4 represents an alternate scheme from FIG. 1 in which low pressure nitrogen is expanded to provide refrigeration.

In FIG. 4, refrigeration is produced by expanding the low pressure gaseous nitrogen product in line 402 and 406 through a turbine 408 after passage through heat exchanger 404. The nitrogen turbine exhaust 410 is then rewarmed against process streams in the main heat exchanger.

Figure 5:
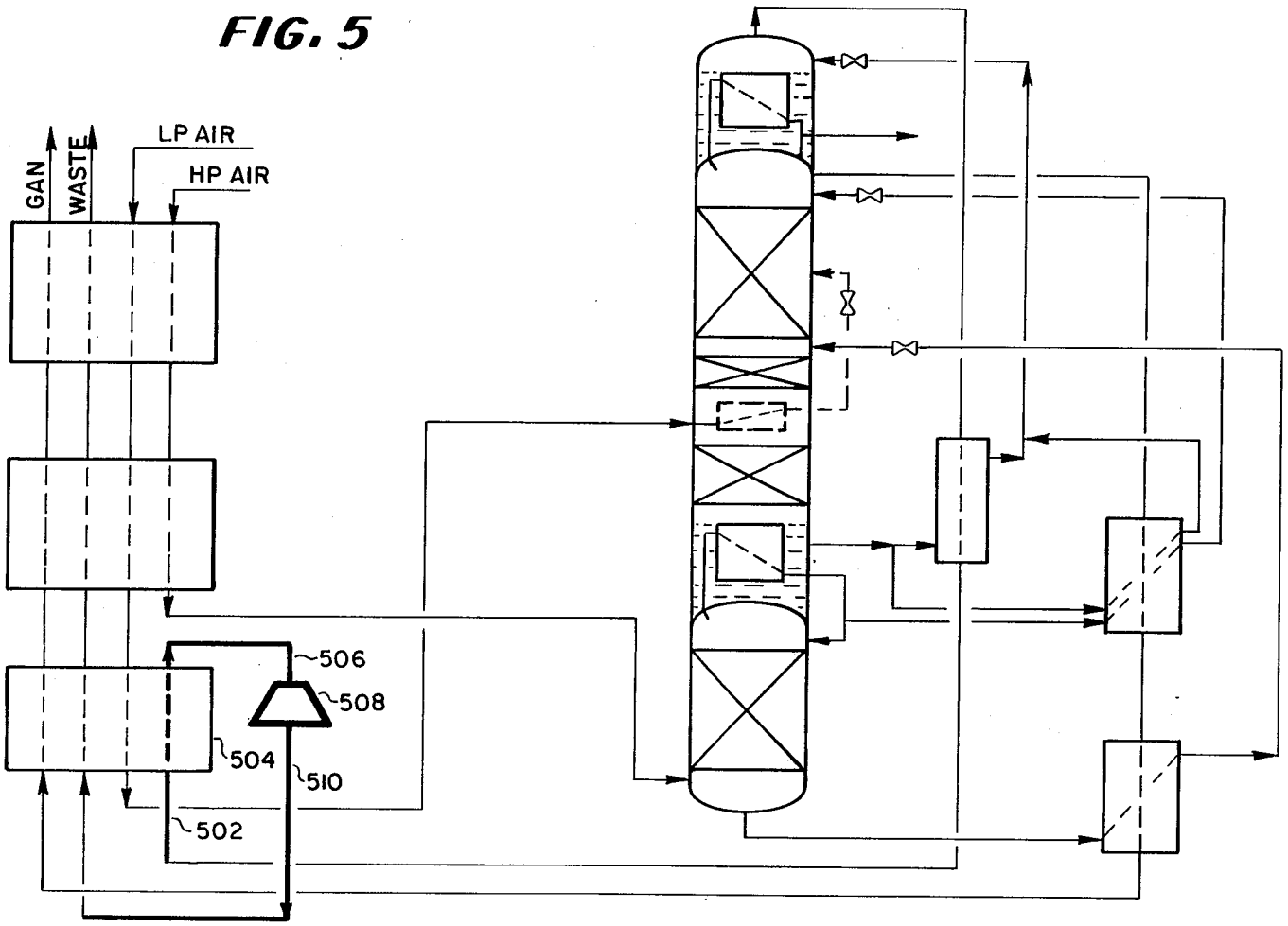
FIG. 5 represents an alternate scheme from FIG. 1 in which a waste, oxygen-enriched stream is expanded for refrigeration.

In FIG. 5, refrigeration is provided by the waste, oxygen-enriched stream 502. After passage through heat exchanger 504, the waste, oxygen-enriched stream, now in line 506, is expanded to a lower pressure and temperature in turbine 508. The turbine exhaust 510 is then rewarmed against process streams in the main heat exchanger.

In the three preceding embodiments, the feed to the expander may pass through an additional, warmer heat exchanger stage prior to expansion.

The present invention enjoys enhanced efficiency of production of large quantities of nitrogen by combining several key features in a two pressure, two column distillation scheme. The scheme provides dual feed air streams at respectively high and low pressures in order to feed both the high pressure and low pressure column independently. This scheme also includes a reboiler-condenser and a vaporizer-condenser which connect the two distillation columns thermodynamically and provide additional reflux for the columns, thereby making the separation in the columns more efficient. Preferably a portion of the high pressure feed air stream is split from the remaining high pressure feed air stream and is expanded in an expansion turbine to a pressure approximately equal to the low pressure column, such that this expanded feed air stream can be fed directly to the low pressure column, thereby increasing its efficiency and providing refrigeration for the separation process.

Alternately, other refrigeration methods can be used as illustrated in FIGS. 2–5. Additionally, added nitrogen reflux is provided to the low pressure column by removing a portion of the reflux from the high pressure column and expanding it into the top of the low pressure column. These features in combination provide only the required high pressure column feed to generate the optimum low pressure column boilup vapor from the reboiler-condenser. The remaining portion of the total air feed is fed directly to the low pressure column. By minimizing the portion of the total feed air compressed to feed the high pressure column, the total energy input for air compression is minimized. In addition, the particular combination of features in the flowschemes of the present invention uncouples the expander flow from mass balance considerations, so that only the required flow of feed air necessary for refrigeration is taken to the expansion turbine. This induces the inefficiency in the exchanger-expander system by reducing the requirement for stream bypasses.

As can be seen in Table 1 below, the process of the present invention is considerably more efficient than the closest known prior art, represented by British Pat. No. 1,215,377 and U.S. Pat. No. 4,222,756.

TABLE 1

| | INVENTION | BR 1,215,377 | U.S. 4,222,756 |
|---|---|---|---|
| CAPACITY | 1000 T/D | 1000 T/D | 1000 T/D |
| PRODUCT PRESSURE | 125 PSIA | 125 PSIA | 125 PSIA |

TABLE 1-continued

| | INVENTION | BR 1,215,377 | U.S. 4,222,756 |
|---|---|---|---|
| ATMOSPHERIC PRESSURE | 14.7 PSIA | 14.7 PSIA | 14.7 PSIA |
| $N_2$ PRODUCTION (% OF AIR FEED) | 72.0 | 70.0 | 52.0 |
| POWER REQ. | 5325 KW | 5540 KW | 6125 KW |
| EFFICIENCY LOSS | — | 4% | 15% |

As can be seen from Table 1, the present invention has a significant efficiency improvement over the closest prior art systems. The table provides comparison of the respective cycles at one particular plant size. However, it is expected that the relative magnitude of efficiency of the present invention over the respective prior art cycles will be maintained for various plant sizes.

The present invention has been described with respect to a preferred embodiment. However, those skilled in the art can contemplate variations from the embodiment set forth that are deemed to be within the scope of the invention, which scope should be ascertained from the claims which follow.

We claim:

1. A process for the production of gaseous nitrogen by the low temperature distillation of air in two distillation columns comprising:

(a) producing two different pressure feed air streams by compression in order to have a low pressure feed air stream and a high pressure feed air stream;

(b) expanding a process stream through an expansion turbine to reduce its pressure and temperature so as to provide refrigeration for the distillation process wherein the expander flow is uncoupled from mass balance considerations so that only the required process stream flow is taken to the expansion turbine;

(c) introducing at least a part of the high pressure feed air stream into a first high pressure, distillation column to provide the required high pressure column feed to generate a low pressure column boilup vapor from a reboiler-condenser;

(d) introducing the low pressure feed air stream into a second, low pressure, distillation column;

(e) condensing a nitrogen reflux stream in the high pressure column by heat exchange of the nitrogen of the high pressure column against the bottom liquid of the low pressure column in said reboiler-condenser;

(f) removing nitrogen-rich liquid from the high pressure column, expanding it and introducing it into the low pressure column as reflux;

(g) removing a bottom stream from the high pressure column, expanding it and introducing it into the low pressure column;

(h) condensing a nitrogen reflux stream in the low pressure column in a vaporizer-condenser against bottom liquid from said column which is expanded to a lower pressure and temperature and introduced into the vaporizer-condenser, and (i) removing a portion of the nitrogen overhead vapor from the low pressure column as a product.

2. The process of claim 1 wherein a liquid nitrogen product is removed from the reflux stream of step (e) or step (h).

3. The process of claim 1 wherein a gaseous waste, oxygen-enriched stream is removed from the overhead of the vaporizer-condenser and is rewarmed against process streams.

4. The process of claim 3 wherein the expanded process stream of step (b) is the gaseous waste, oxygen-enriched stream.

5. The process of claim 1 wherein the feed air is initially dried of any moisture and separated from any carbon dioxide by passage through a molecular sieve adsorption system.

6. The process of claim 1 wherein the two different pressure feed air streams are cooled by heat exchange against process streams.

7. The process of claim 1 wherein at least a portion of the feed air stream to the low pressure column reboils the low pressure column before being introduced into said column as reflux.

8. The process of claim 1 wherein the expanded process stream of step (b) is a portion of the high pressure feed air stream.

9. The process of claim 1 wherein the expanded process stream of step (b) is a nitrogen stream from the overhead of the high pressure, distillation column.

10. The process of claim 1 wherein the expanded process stream of step (b) is the nitrogen product from the overhead of the low pressure, distillation column.

11. A process for the production of gaseous nitrogen by the low temperature distillation of air in two distillation columns comprising:

(a) producing two different pressure feed air streams by compression in order to have a low pressure feed air stream and a high pressure feed air stream;

(b) splitting the high pressure feed air stream into an expander feed air stream and a remaining high pressure feed stream which is introduced into a first, high pressure, distillation column to provide the required high pressure column feed to generate a low pressure column boilup vapor from a reboiler-condenser;

(c) expanding the expander feed air stream through an expansion turbine to reduce its pressure and temperature and desuperheating the expanded feed air stream by heat exchange against a process stream wherein the expander flow is uncoupled from mass balance considerations so that only the required feed air stream flow is taken to the expansion turbine;

(d) introducing the low pressure feed air stream and the expanded feed air stream into a second, low pressure, distillation column;

(e) condensing a nitrogen reflux stream in the high pressure column by heat exchange of the nitrogen of the high pressure column against the bottom liquid of the low pressure column in said reboiler-condenser;

(f) removing nitrogen-rich liquid from the high pressure column, expanding it and introducing it into the low pressure column as reflux;

(g) removing a bottom stream from the high pressure column, expanding it and introducing it into the low pressure column;

(h) condensing a nitrogen reflux stream in the low pressure column in a vaporizer-condenser against bottom liquid from said column which is expanded to a lower pressure and temperature and introduced into the vaporizer-condenser, and (i) removing a portion of the overhead nitrogen vapor from the low pressure column as a product.

12. The process of claim 11 wherein a portion of the nitrogen product desuperheats the expanded feed air stream.

13. An apparatus for the production of gaseous nitrogen by the low temperature distillation of air comprising:

(a) two distillation columns consisting of a high pressure column and a low pressure column connected by a reboiler-condenser;

(b) means for conducting a low pressure feed air stream to said low pressure column;

(c) means for conducting at least a portion of a high pressure feed air stream to said high pressure column to provide the required high pressure column feed to generate a low pressure column boilup vapor from said reboiler-condenser;

(d) a turbine for expanding a process stream to a lower pressure and temperature to provide refrigeration wherein the expander flow is uncoupled from mass balance considerations so that only the required process stream flow is taken to the turbine;

(e) means for conducting a nitrogen stream from the reboiler-condenser between the two distillation columns to the low pressure column;

(f) means for conducting a bottom stream from the base of the high pressure column to the low pressure column;

(g) a vaporizer-condenser at the top of the low pressure column which refluxes a nitrogen stream by heat exchange with a bottom stream from the base of the low pressure column, and (h) means for recovering a nitrogen product from the overhead of the low pressure column.

14. The apparatus of claim 13 including means for separating a portion of the high pressure feed air stream for expansion in said turbine and introducing of the turbine exhaust into the low pressure, distillation column.

15. The apparatus of claim 14 including a desuperheater heat exchanger for cooling the expanded turbine-exhaust against process streams before introducing the turbine exhaust into the low pressure column.

16. The apparatus of claim 14 including a reboiler in the low pressure column that cools the feed air stream to said column and reboils the fluid in the column.

17. The apparatus of claim 13 including means for providing reflux to the low pressure column from the vaporizer-condenser.

18. The apparatus of claim 13 including expansion means for the nitrogen stream of paragraph (e) and the bottom stream of paragraph (f).

19. The apparatus of claim 13 including a main heat exchanger for cooling the low pressure feed stream and the high pressure feed air stream against process streams.

* * * * *